US006181067B1

(12) United States Patent
Dalton

(10) Patent No.: US 6,181,067 B1
(45) Date of Patent: Jan. 30, 2001

(54) PORTABLE LIGHTING PRODUCT, A PORTABLE LIGHTING PRODUCT CIRCUIT AND A FUNCTIONING METHOD FOR A PORTABLE LIGHTING PRODUCT CIRCUIT

(75) Inventor: David R. Dalton, North Turramurna (AU)

(73) Assignee: Eveready Battery Company, Inc., St. Louis, MO (US)

( * ) Notice: Under 35 U.S.C. 154(b), the term of this patent shall be extended for 0 days.

(21) Appl. No.: 09/297,554

(22) PCT Filed: Nov. 4, 1997

(86) PCT No.: PCT/AU97/00743

§ 371 Date: Jul. 12, 1999

§ 102(e) Date: Jul. 12, 1999

(87) PCT Pub. No.: WO98/20276

PCT Pub. Date: May 14, 1998

(30) Foreign Application Priority Data

May 11, 1996 (AU) ..... 70634/96

(51) Int. Cl.[7] ..... H05B 37/00

(52) U.S. Cl. ..... 315/86; 362/183

(58) Field of Search ..... 315/200 A, 86, 315/307, 5 G, 33, 265, 56; 362/183, 202, 190, 199

(56) References Cited

U.S. PATENT DOCUMENTS

| | | | |
|---|---|---|---|
| 3,959,706 | 5/1976 | Mabuchi et al. . | |
| 4,297,590 | 10/1981 | Vail . | |
| 4,317,162 | 2/1982 | Richards et al. . | |
| 4,667,142 | 5/1987 | Butler . | |
| 5,272,606 | 12/1993 | Blaney . | |
| 5,357,411 * | 10/1994 | Menke et al. | 362/138 |
| 5,821,697 * | 10/1998 | Weber | 315/200 A |

FOREIGN PATENT DOCUMENTS

| | | |
|---|---|---|
| 1006476 | 1/1976 | (AU) . |
| 9700743 | 11/1997 | (AU) . |
| 3834554 | 4/1990 | (DE) . |
| 2592458 | 7/1987 | (FR) . |
| 2200804 | 8/1988 | (GB) . |

* cited by examiner

*Primary Examiner*—Don Wong
*Assistant Examiner*—Chuc Tran D
(74) *Attorney, Agent, or Firm*—Robert W. Welsh

(57) ABSTRACT

The present invention relates to a circuit for a portable lighting product such as flashlight, lantern, desk lamp, area light, combination area light and flashlight, front and rear bicycle light, emergency light, night light, rechargeable versions of any of those products previously mentioned, in which several power sources are provided. The invention includes the feature that each power source is electrically isolate from each other by the switch in mechanism or mechanisms, when the portable lighting product is switched to the off condition. The power sources can include single dry cells, or sets of series connected dry cells of any number.

43 Claims, 11 Drawing Sheets

41
4

41
52
160
49
180
51
51
51

41
50
88
52
160
51
51
51

41
50
160
180
51
51
51

160
52
180
41
50

PORTABLE LIGHTING PRODUCT, A PORTABLE LIGHTING PRODUCT CIRCUIT AND A FUNCTIONING METHOD FOR A PORTABLE LIGHTING PRODUCT CIRCUIT

FIELD OF THE INVENTION

The present invention relates to a portable lighting product, a portable lighting product circuit and a method of operating a portable lighting product circuit, and more particularly to portable lighting products including flashlights and bicycle lights, camping lights and other portable lighting products.

BACKGROUND OF THE INVENTION

In many applications of portable lighting products, users are ultimately concerned with such factors as bulk of product and the running life of that product. For example for flashlights with 6 or 8 dry cells in series, these may need to be replenished or replaced either at the start of a shift or during a shift and the human condition will dictate that it will be at the worst possible time.

Generally with 6 and 8 dry cell flashlights, the dry cells are connected in series in a straight line making the bodies of the flashlights relatively long. This can render such flashlights as menacing to the general public because of a club like appearance. Also their relatively long length renders them difficult to store in cupboards and vehicles, or when carried on belts they can interfere with the wearer's movement. Such flashlights can at times be any thing up to 1 meter or 39 inches long.

Also, in today's market, brighter operating lamps are being developed, but at the relatively high voltages of 9 or 12 volts, the filaments of such lamps are relatively fragile. Such fragility can b directly proportional to the voltage at which the lamp is operated.

Whilst a solution to the first and second mentioned difficulties can be to provide the power supply from sets of dry cells in parallel, this solution results in an additional problem. When sets of series connected dry cells are connected in parallel, there are risks of dissipation and transfer of energy from one set of dry cells to another, when they are not powering a lamp. This can lead to premature dissipation of the available energy in the dry cells. Potential risks of premature dissipation is one reason why manufacturers have not utilised parallel dry cell arrangements for dry cell powered products.

It is an object of the invention to provide a portable lighting product, a portable lighting product circuit and a method of functioning of a portable lighting product circuit which ameliorates, at least partially, at least one of the disadvantages of the prior art.

Whilst the following discussion and description of the embodiments relates in part to flashlights, it will be understood that the invention is applicable to any portable lighting product, and can be readily incorporated therein without departing from the scope of the following inventions.

SUMMARY OF THE INVENTION

The present invention provides an electrical circuit for a portable lighting product which includes a lamp holder means and one power source holding means to hold at least two power sources, said power source holding means having one set of positive and negative terminals for each power source that it is to hold, said sets of terminals being adapted to be electrically connected in parallel with at least one other set of positive and negative terminals that function as electrical connections for said lamp holder within said electrical circuit, said circuit being such that when said circuit is closed said positive terminals of said sets are connected in parallel with said positive terminal of said lamp holder and said negative terminals of said sets are connected in parallel with the negative terminal of said lamp holder and when said circuit is open at least one terminal, for each power source, of said power source holding means is electrically isolated.

The present invention provides an electrical circuit for a portable lighting product which includes a lamp holder means and at least two power source holding means each to hold at least one power source, each of said power source holding means having one set of positive and negative terminals for each power source that it is to hold, said sets of terminals being adapted to be electrically connected in parallel with at least one other set of positive and negative terminals that function as electrical connections for said lamp holder within said electrical circuit, said circuit being such that when said circuit is closed said positive terminals of said are connected in parallel with said positive terminal of said lamp holder and said negative terminals of said sets are connected in parallel with the negative terminal of said lamp holder and when said circuit is open at least one terminal, for each power source, of said power soul holding means is electrically isolated.

Preferably said power source holding means will hold only one power source.

Preferably, wherein connection in parallel when the circuit is closed and the electrical isolation when the circuit is open, are each performed by a single action.

Preferably the single action closes or opens individual switches associated with said power sources.

Preferably the isolation of said sets of series connected dry cells occurs at one of the following: on the positive side of said power sources; on the negative side of said power sources; on both the negative side and positive sides of said power sources; or on a combination of the positive and negative sides of said power sources.

Preferably said two switches and said single action is achieved by means of a double pole double throw switch.

Preferably each power source is located in a separate container or housing for each set.

Preferably all of said power sources are located in a single container having appropriate electrical connections with said circuit.

Preferably said lamp holder means has a lamp means which is selected from one of the following: a halogen type; a krypton type; a vacuum type; a xenon type; a lamp means which includes a filament encased in an atmosphere of a gas or combination of gases.

Preferably said power source is a single dry cell.

Preferably said power source is effectively a single dry cell made up of a set of series connected dry cells.

Preferably said power source is a set of series connected dry cells.

Preferably said dry cells are selected from one of the following sizes or types: AA size, AAA size, C size, D size, lantern type, 9 volt rectangular type. Preferably said portable lighting product is selected from any one of the following products: flashlight, lantern, desk lamp, area light, combination area light and flashlight, front and rear bicycle light, emergency light, night light, rechargeable versions of any of those products previously mentioned.

The invention also provides a portable lighting product which includes a lamp holder means having two terminals with a first terminal being adapted to be in electrical connection with a first terminal of each of at least two power sources; a second terminal of said lamp holder being adapted to be electrically connected to a second terminal of each of said at least two power sources, said circuit including at least one switching mechanism which electrically isolates each power source from each other when said at least one switching mechanism is in a first condition, but when in a second condition said circuit is closed by said first terminals of said sets being connected in parallel with said first terminal of said lamp holder and said second terminals of said sets being connected in parallel with the second terminal of said lamp holder.

The invention also provides a portable lighting product which includes a lamp holder means with two terminals having a first terminal adapted to be electrically connected to a first terminal of each of at least two power sources, the second terminal of each of said at least two power sources being adapted to be electrically connected to a switch mechanism, whereby the second terminal of said lamp holder means is adapted to be selectively electrically connected to said second terminal of said power sources when said switch mechanism is in a first condition such that each of said power sources are electrically connected to said lamp holder means in parallel, said switch mechanism being adapted to adopt a second condition at which each of said power sources are electrically isolated from each other.

Preferably said portable lighting product also includes at least one housing for each of said power sources.

Preferably said portable lighting product includes at least one housing which can hold more than one power source.

Preferably in the electrical connection of said second terminal of said power sources to said switch mechanism or from said first terminal of said lamp holder means to said first end of said power sources another switch is located in each connection or in at least one group of connections.

Preferably when there is said another switch in each connection, said another switch is of the single pole single throw variety.

Preferably when there is said another switch in at least one group of connections, said another switch has as at least the same number of poles as the numbers of said connections it is connected into.

If there are two or more power sources, preferably said switch mechanism connects said two, or any two, if there are more than two power sources, into electrical connectivity in parallel with said lamp holder means.

Preferably said switching mechanism has or another switching mechanism has means for an operator to select at any time, which power source or groups of power sources are to be connected in parallel with each other and said lamp holder means, if more than two power sources are present.

Preferably said lamp holder means can receive a lamp means which is on of the following types: a halogen type; a krypton type; a vacuum type; a xenon type; a lamp means which includes a filament encased in an atmosphere of a gas or combination of gases.

Preferably said power source is a single dry cell.

Preferably said power source is effectively a single dry cell made up of a set of series connected dry cells.

Preferably said power source is a set of series connected dry cells.

Preferably said dry cells are selected from one of the following sizes or types: AA size, AAA size, C size, D size, lantern type, 9 volt rectangular type.

Preferably said portable lighting product is selected from any one of the following products: flashlight, lantern, desk lamp, area light, combination area light and flashlight, front and rear bicycle light, emergency light, night light, rechargeable versions of any of those products previously mentioned.

A further invention provides a portable lighting product which includes a lamp holder means having two terminals with a first terminal being adapted to be in electrical connection with a first terminal of at least two power sources and a second terminal of said lamp holder means being adapted to be electrically connected to a second terminal of said at least two power sources, said circuit including at least one switching mechanism which electrically isolates each of said power sources but allowing only one of said power sources to be in electrical connection with said lamp holder means at any time.

Preferably said portable lighting product is selected from any one of the following products: flashlight, lantern, desk lamp, area light, combination area light and flashlight, front and rear bicycle light, emergency light, night light, rechargeable versions of any of those products previously mentioned.

The invention also provides a functioning method for a portable lighting product circuit for disconnecting from said portable lighting product circuit more than one power sources which are or could be connected in parallel with a lamp holder means in said portable lighting product circuit, said method including the step of electrically isolating each of said power sources from each other power source when they are not electrically connected to said lamp holder means.

Preferably said power source is a single dry cell.

Preferably said power source is effectively a single dry cell made up of a set of series connected dry cells.

Preferably said power source is a set of series connected dry cells.

Preferably said dry cells are selected from one of the following sizes or types: AA size, AAA size, C size, D size, lantern type, 9 volt rectangular type.

Preferably said portable lighting product is selected from any one of the following products: flashlight, lantern, desk lamp, area light, combination area light and flashlight, front and rear bicycle light, emergency light, night light, rechargeable versions of any of those products previously mentioned.

The invention also provides a portable lighting product including a housing defining respective chambers for a plurality of power sources; a light source portion associated with said housing including a holder for a lamp; and electrical circuit means including switching means adjustable between a first condition in which the lamp holder is electrically connected in parallel with said power sources, and a second condition in which the switch breaks respective electrical circuits linking said lamp holder and the power sources and linking the sets of power sources.

Preferably said power source is a single dry cell.

Preferably said power source is effectively a single dry cell made up of a set of series connected dry cells.

Preferably said power source is a set of series connected dry cells. Preferably said dry cells are selected from one of the following sizes or types: AA size, AAA size, C size, D size, lantern type, 9 volt rectangular type.

Preferably said portable lighting product is selected from any one of the following products: flashlight, lantern, desk lamp, area light, combination area light and flashlight, front and rear bicycle light, emergency light, night light, rechargeable versions of any of those products previously mentioned.

The embodiments of the present invention provide the advantage of ensuring that each power source or set of series connected dry cells are disconnected from the circuit with the lamp holder means, as well as each of the other power sources or sets of series connected dry cells. By being so, the embodiment of the invention ensures that the power sources or sets of dry cells are prevented from dissipating prematurely.

When this advance is coupled with the advances in lamps and their ability to luminesce to a greater degree at lower voltages, and the fact that such lamps are more susceptible to damage when operated at higher voltages, a longer life of lamp may result together with a relatively unnoticeable reduction in the luminescence of the lamp.

BRIEF DESCRIPTION OF THE DRAWINGS

An embodiment of the present invention will now be describe by way of example only, with reference to the accompanying drawings in which.

DETAILED DESCRIPTION OF THE EMBODIMENTS

Figure 1:
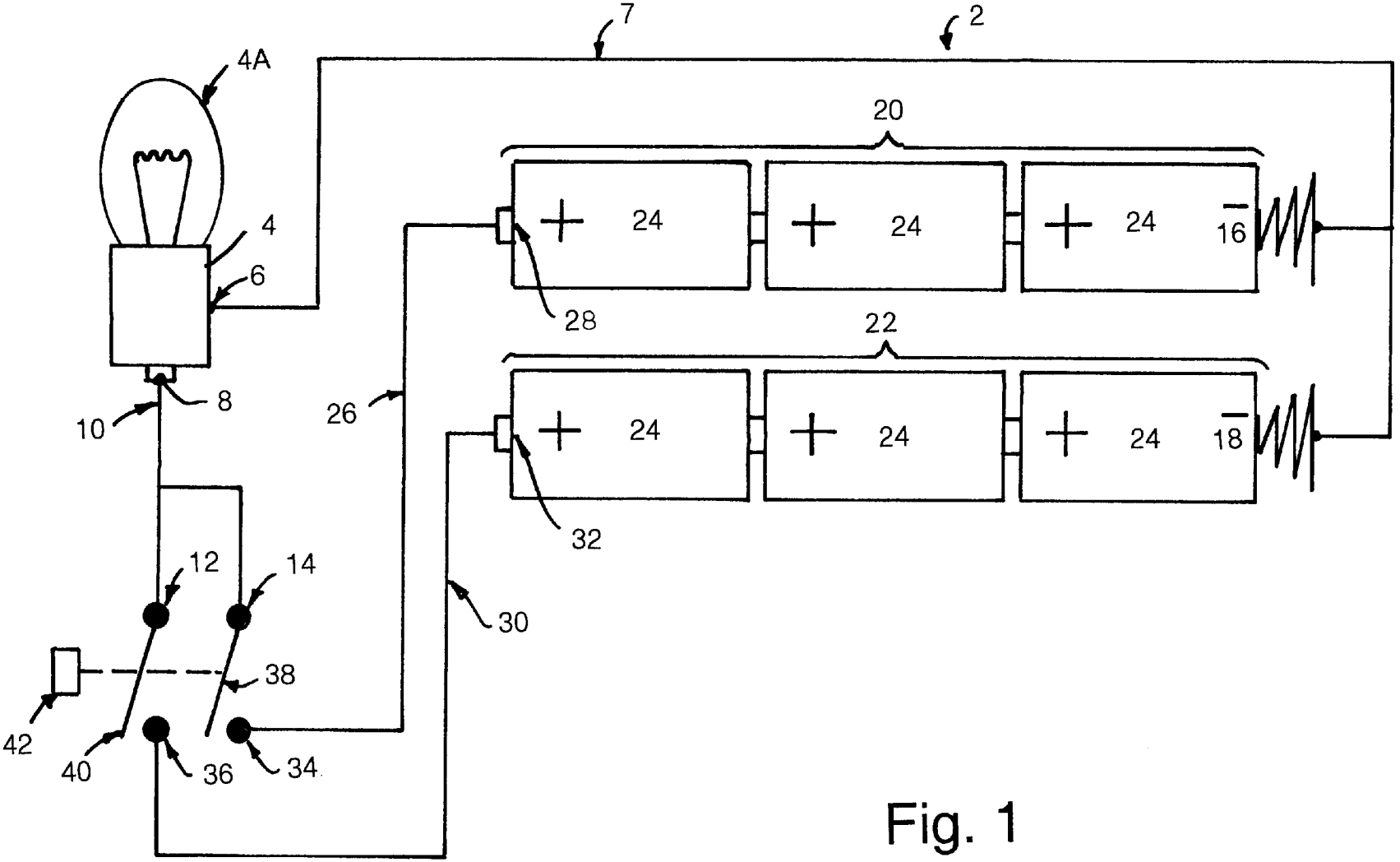
FIG. 1 is a schematic diagram of a flashlight circuit which is an embodiment of the present invention.

Illustrated in FIG. 1 is a portable lighting product circuit 2. In the portable lighting product circuit 2 is a lamp 4A in a lamp holder 4 which includes a ground terminal or body 6 which makes contact with a ground terminal of a lamp 4A. The lamp 4A held by the lamp holder 4 can be of any sort but is preferably of the halogen or krypton type which operate at 3.6 volts or 4.7 volts. The ground terminal 6 is electrically connected by an electrical connection means 7 (which can be a wire or other electrical connection means such as a printed circuit board track, a case connection or a combination of such electrical connection means. These will be hereinafter referred to as "electrical connection means") to the negative ends 16 and 18 of two power sources 20 and 22 each made up of a set of three series connected dry cells 24. Each of the three series connected dry cells 24 in each power source 20 and 22 are all the same size, generally of the AA, AAA, C, D size and are approximately of 1 to 1.5 volts of electrical potential. Alternatively the dry cells could each be of the lantern type or rectangular 9 volt type These are connected positive end to negative end in a series connection as is commonly known in the art, in each of the power sources 20 and 22.

A second terminal 8 of lamp holder 4 is electrically connected by an electrical connection means 10 to two parallel connected poles, the first being pole 12 and the second being pole 14, An electrical connection means 26 connects the positive end 28 of the first power source 20 to pole 34 whilst an electrical connection means 30 connects the positive end 32 of the power source 22 to pole 36.

The circuit between the pole 34 and pole 14 can be closed by means of switching mechanism 38. Whereas the circuit between the pole 36 and the pole 12 can be closed by the switching mechanism 40. The switching mechanisms 38 and 40 are combined into a single switch 42 which is a double pole, double throw switch. Preferably the switch 42 is of small proportions, such as one having a length and width of approximatley 10 mm. The double pole, double throw switch is utilised so that a single action of the operator moving the switch to a first condition will electrically isolate each power source 20 and 22 when the lamp 4A in the lamp holder 4 is not emitting light (ie the portable lighting product in which the circuit is installed is switched off). The double pole double throw switch 42 when moved to a second condition puts both power sources 20 and 22 in parallel connection with the lamp holder 4.

In an alternative embodiment, the portable lighting product circuit 2 can be modified by the switch 42 being substituted by a switching mechanism that operates each switching mechanism 38 and 40 individually or alternately by the operators action. In particular the switches 38 and 40 could be individual switches and individually opened or closed. In this case the operator will know that either or both or none of the power sources 20 or 22 are connected in the circuit because the lamp 4A in the lamp holder 4 will be emitting light, albeit at low wattage if only one is connected.

In a still further embodiment, the portable lighting product circuit 2 of FIG. 1 can be modified by the addition of a single pole, single throw switch in the electrical connection means 26 and 30. These additional switches can be the same as switches 64 and 66 of FIGS. 23 and 24. In this embodiment an operator can select either one or both of the power sources 20 or 22 by closing one or both of the single pole single throw switches respectively. This will identify or set which power source (20 or 22 or both) will supply current to the lamp holder 4 when the switch mechanisms 40 and 38 are closed in the switch 42.

The principles and modifications and features discussed in the previous two paragraphs can also be applied to the circuits of FIGS. 23 to 27 inclusive.

Figure 4:
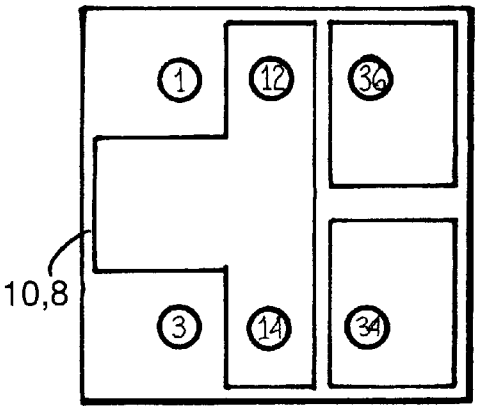
FIG. 4 is a printed circuit board for use with the apparatus of FIG. 1.
Figure 3:
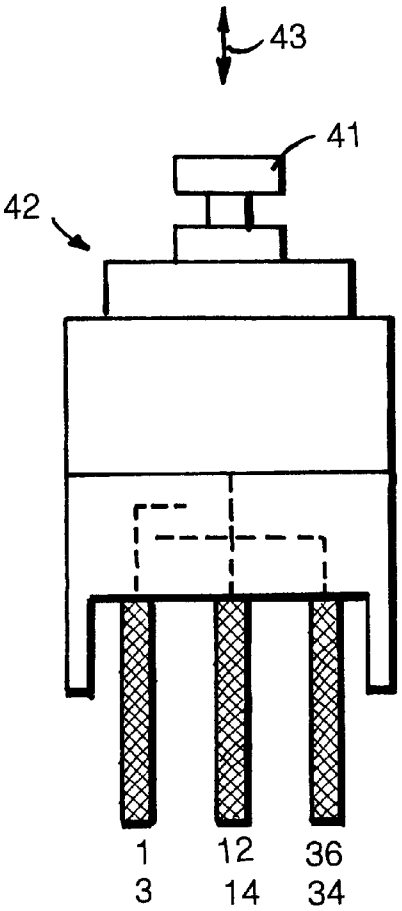
FIG. 3 is a side view of the apparatus of FIG. 2.
Figure 2:
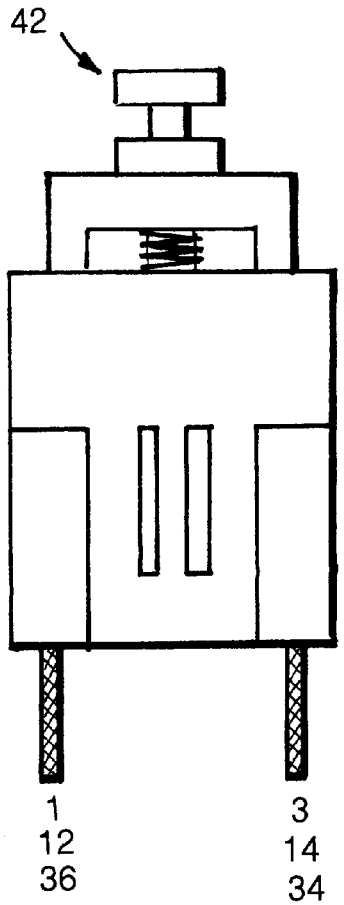
FIG. 2 is an end view of a switching mechanism for use with the embodiment of FIG. 1.
Figure 5:
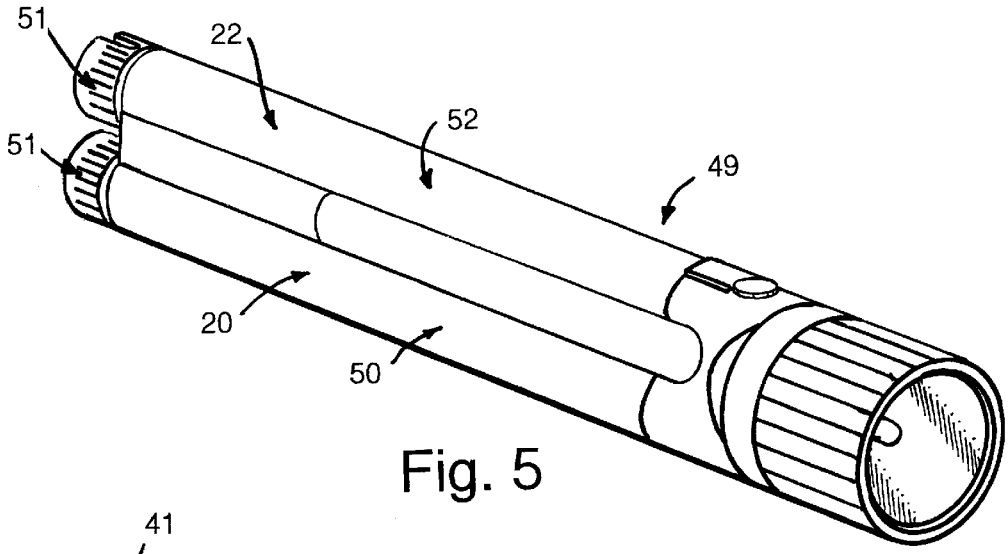
FIGS. 5, 6, 7, 8, 9 and 10 illustrate a perspective, back, top, side, bottom and front views of a flashlight which can utilise the present invention.
Figure 11:
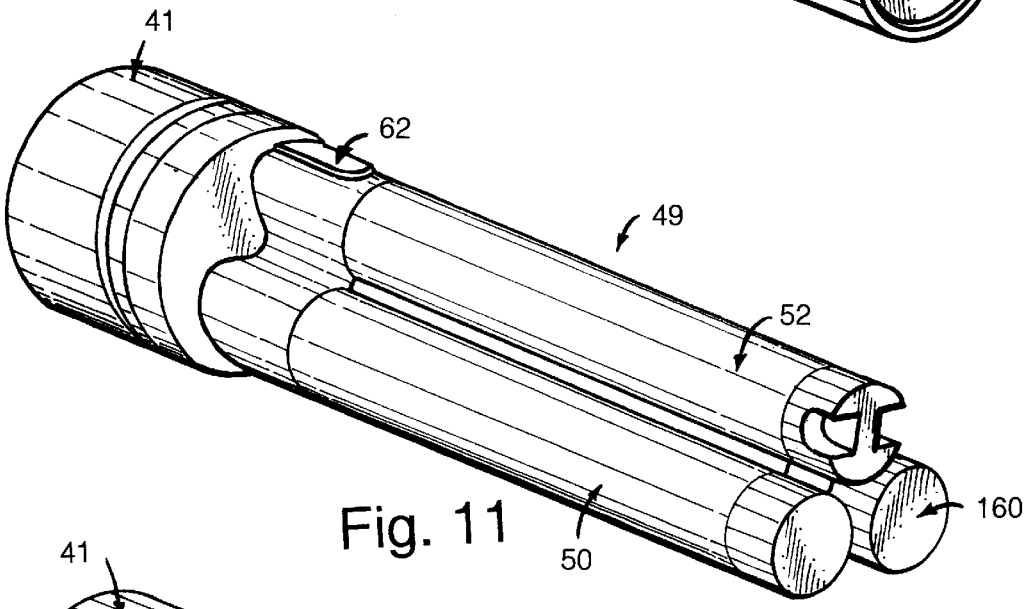
FIGS. 11 through to 16 illustrate a perspective, back, top, side, bottom and front views of a flashlight similar to that of FIGS. 5 to 10, having three power source housings.
Figure 17:
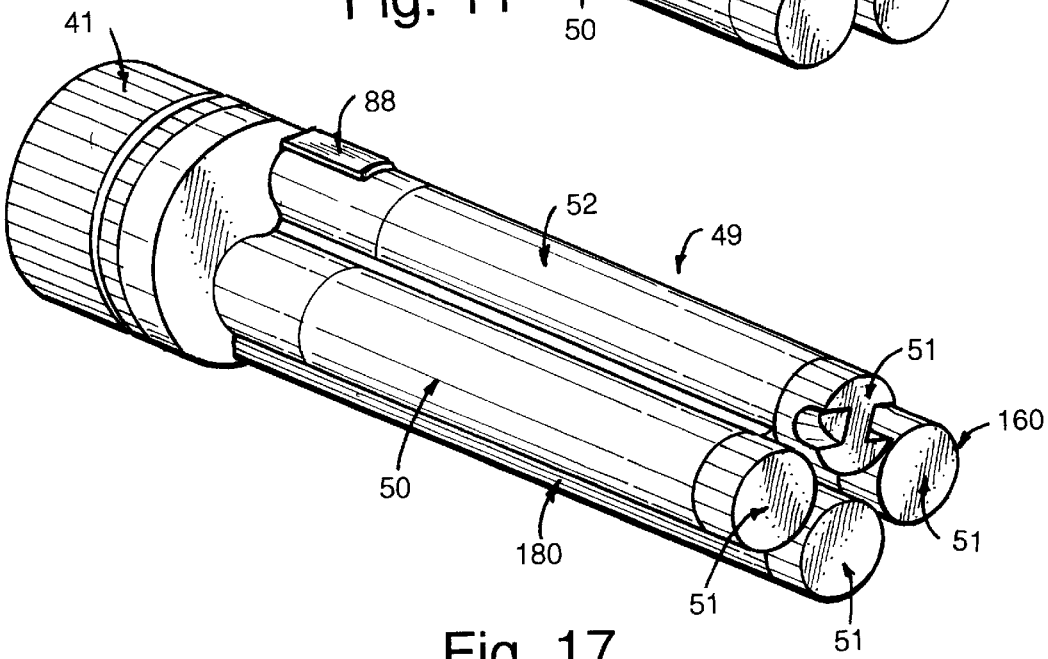
FIGS. 17 through to 22 illustrate a perspective, back, top, side, bottom and front view. of a flashlight, similar to that of FIGS. 5 to 10, having four power source housings.
Figure 10:
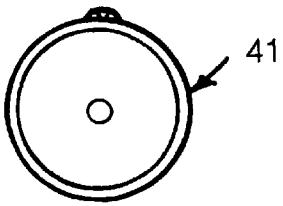
Figure 7:
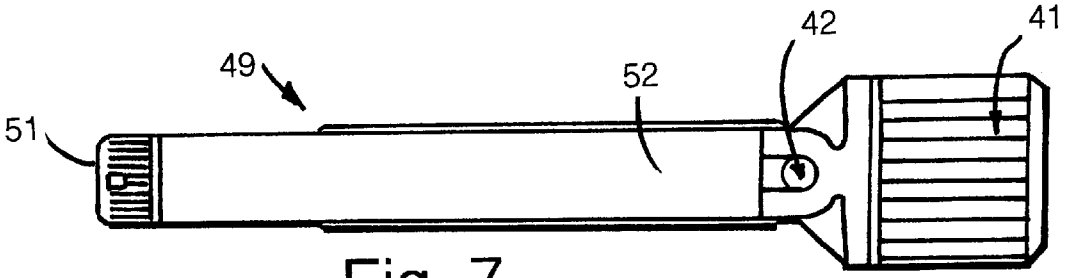
Figure 8:
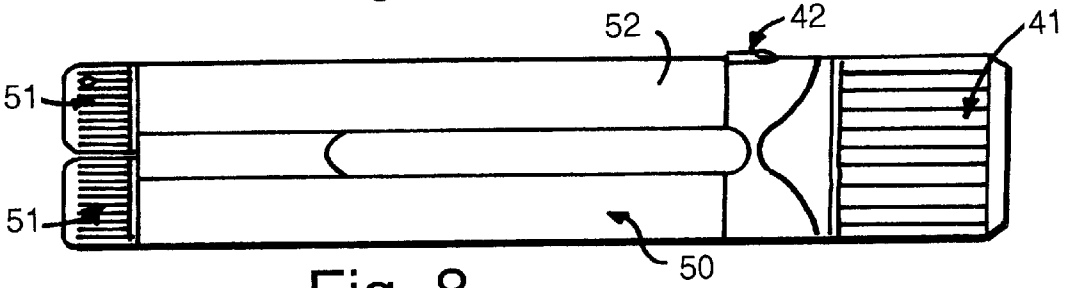
Figure 9:
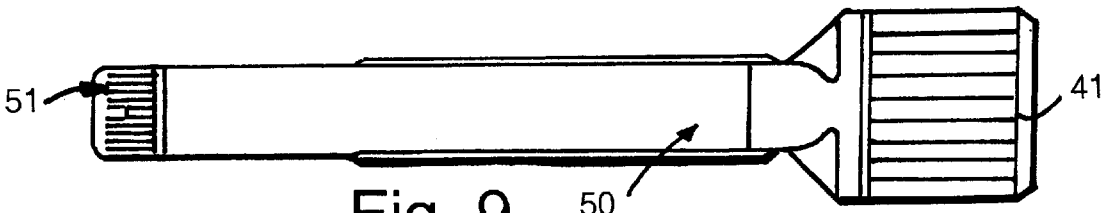
Figure 6:
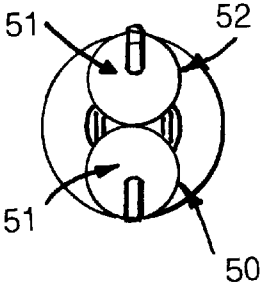
Figure 16:
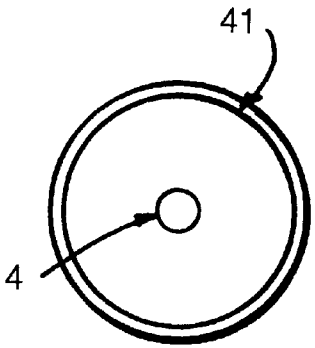
Figure 13:
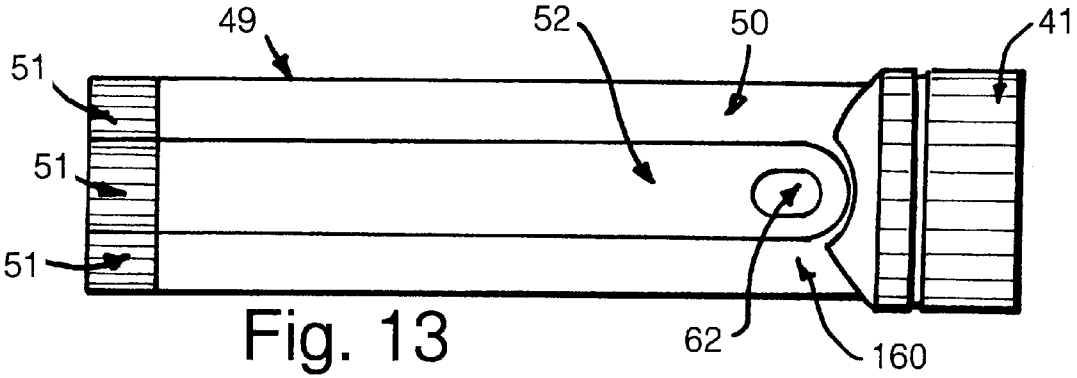
Figure 14:
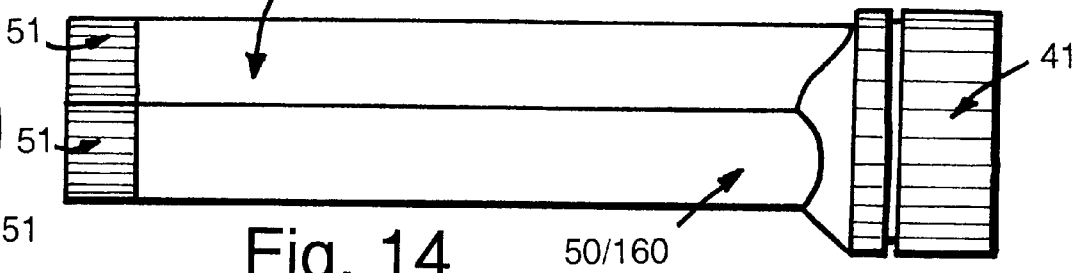
Figure 15:
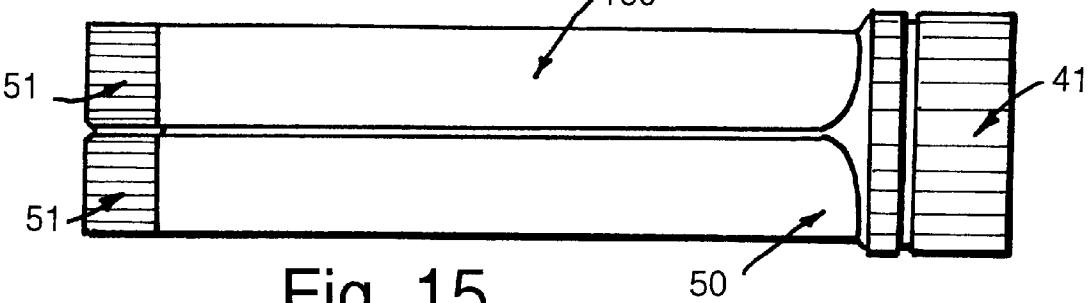
Figure 12:
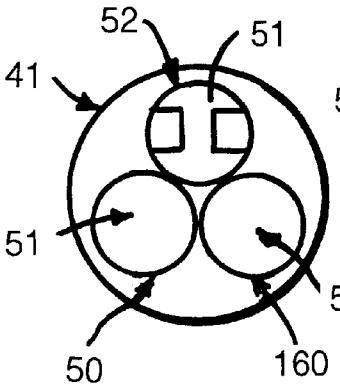
Figures 18, 19, 20, 21, 22:
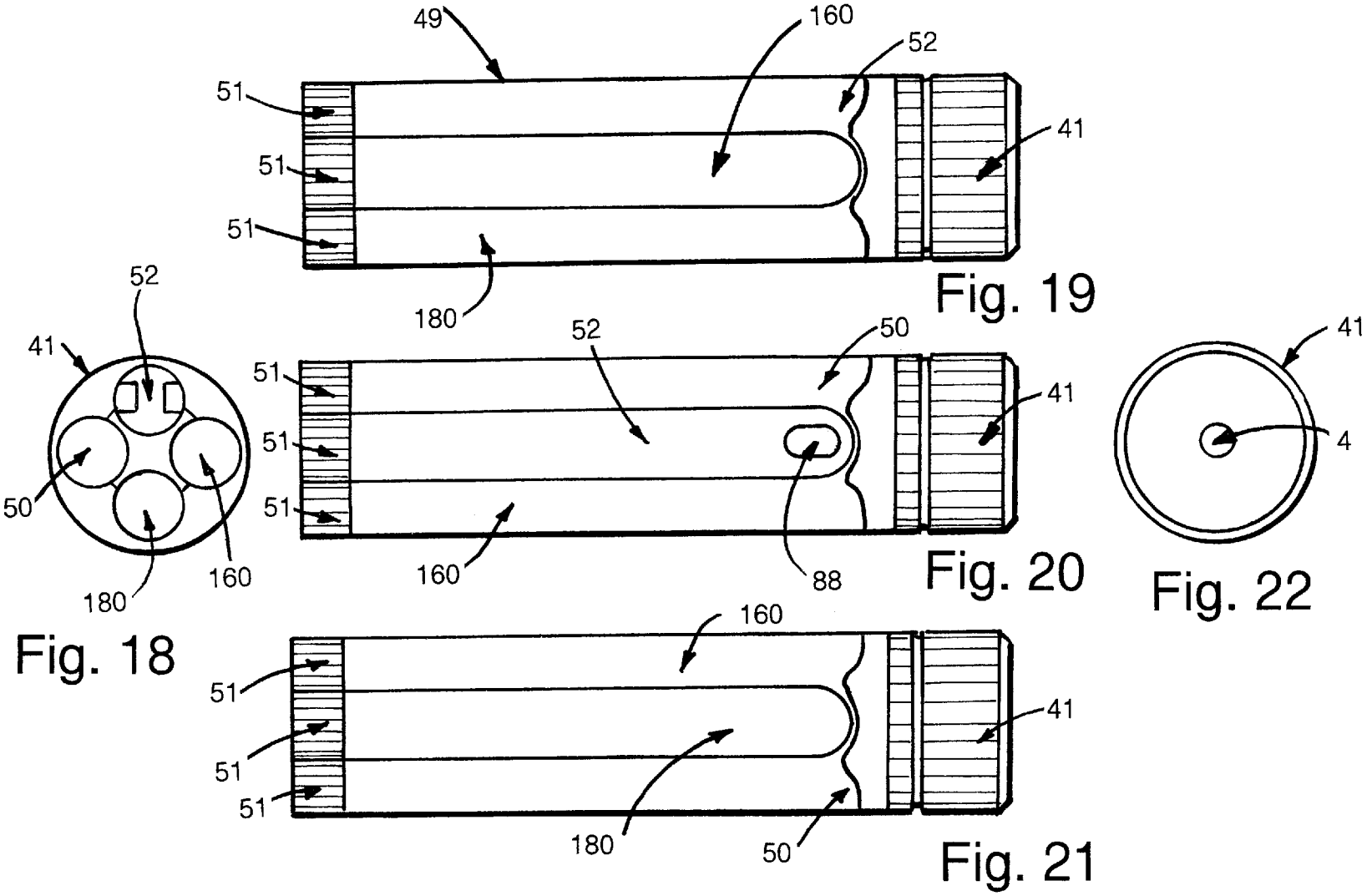

As illustrated in FIGS. 2, 3 or 4 the switching mechanism 42 has six terminals and is used as a double pole double throw switch. However, for the embodiment illustrated in FIGS. 1 and FIGS. 5 to 10, the poles 1 and 3 as illustrated in FIG. 4 are not connected into the circuit. The poles 12 and 14 are common and connected to a common terminal 8 by electrical connection means 10 whereas poles 36 and 34 are the terminations of electrical connection means 26 and 30.

In the end view of FIG. 2 the switch 42 is in the off condition, whereas the switch 42 in the side view of FIG. 3 is switched to the on condition, which is done by the depression of the button 41 in the downward direction of arrows 43.

When the switch 42 is in a condition at which the portable lighting product circuit 2 is switched "off", the poles 1 & 12 and 3 & 14 are closed (or electrically connected) whereas poles 12 & 36 and 14 & 34 are open (or not electrically connected). Whereas when the portable lighting product circuit 2 is in the "on" condition, poles 1 & 12 and 3 & 14 are open (or not electrically connected) and poles 12 & 36 and 14 & 34 are closed (or electrically connected).

The portable lighting product circuit 2 illustrated in FIG. 1 can be installed in the flashlight 49 of FIGS. 5 to 10.

In the flashlight 49 illustrated in FIGS. 5 to 10, each power source 20 and 22 is physically isolated from each other inside power source housings 50 and 52 respectively. Each power source housing 50 and 52 is closed by a sealed and screwed on end cap 51. The portable lighting product circuit 2 of FIG. 1 can be installed in any appropriate location inside the body of flashlight 49. As can be seen from FIGS. 7 and 8, the switch 42 is located in the vicinity of the terminus of the power source housings 50 and 52. Some other components of the portable lighting product circuit 2 can be located in the region between the termini of the power source housings 50 and 52 and the lamp end 41.

Illustrated in FIGS. 11 to 16 is an embodiment similar to that of FIGS. 5 to 10, wherein three power source housings 50, 52 and 160 are provided. With this embodiment, the portable lighting product circuit 2A of FIG. 23 can be utilised.

Figure 23:
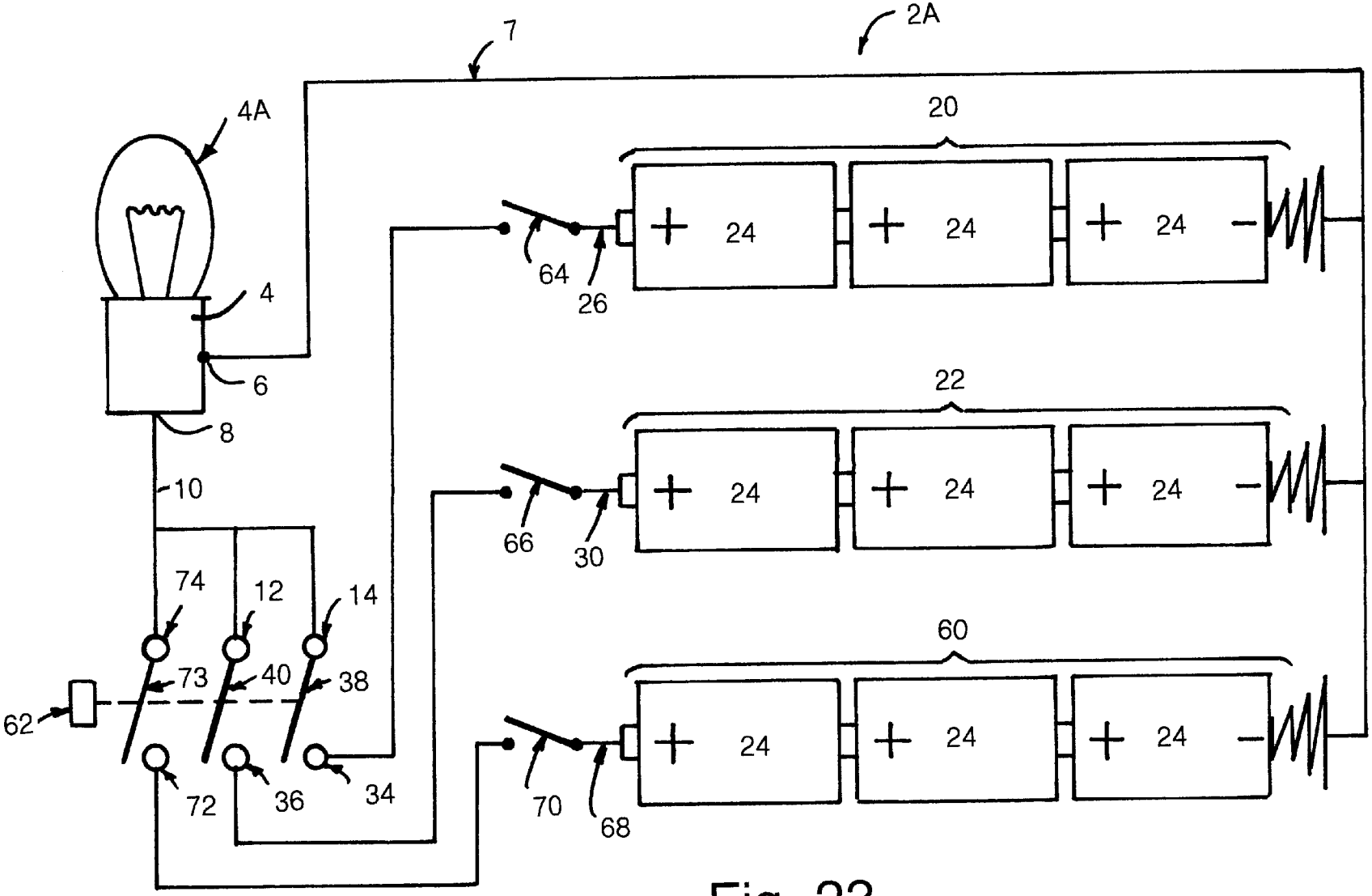
FIG. 23 illustrates a schematic of a portable lighting product circuit for use with the flashlight of FIGS. 11 to 16.

In FIGS. 11 to 16 like features with FIGS. 5 to 10 have been like numbered and the same is the case with FIGS. 1 and 23.

The power source housing 160 (see FIG. 11) houses power source 60 (see FIG. 23) including three series connected dry cells 24 (see FIG. 23). In FIG. 23 there is positioned in the circuit 2A a three pole switch 62 which activates switch mechanisms 38, 40 as in FIG. 1, but as well, an additional switch mechanism 73 which when closed electrically connects poles 72 and 74.

Figure 24:
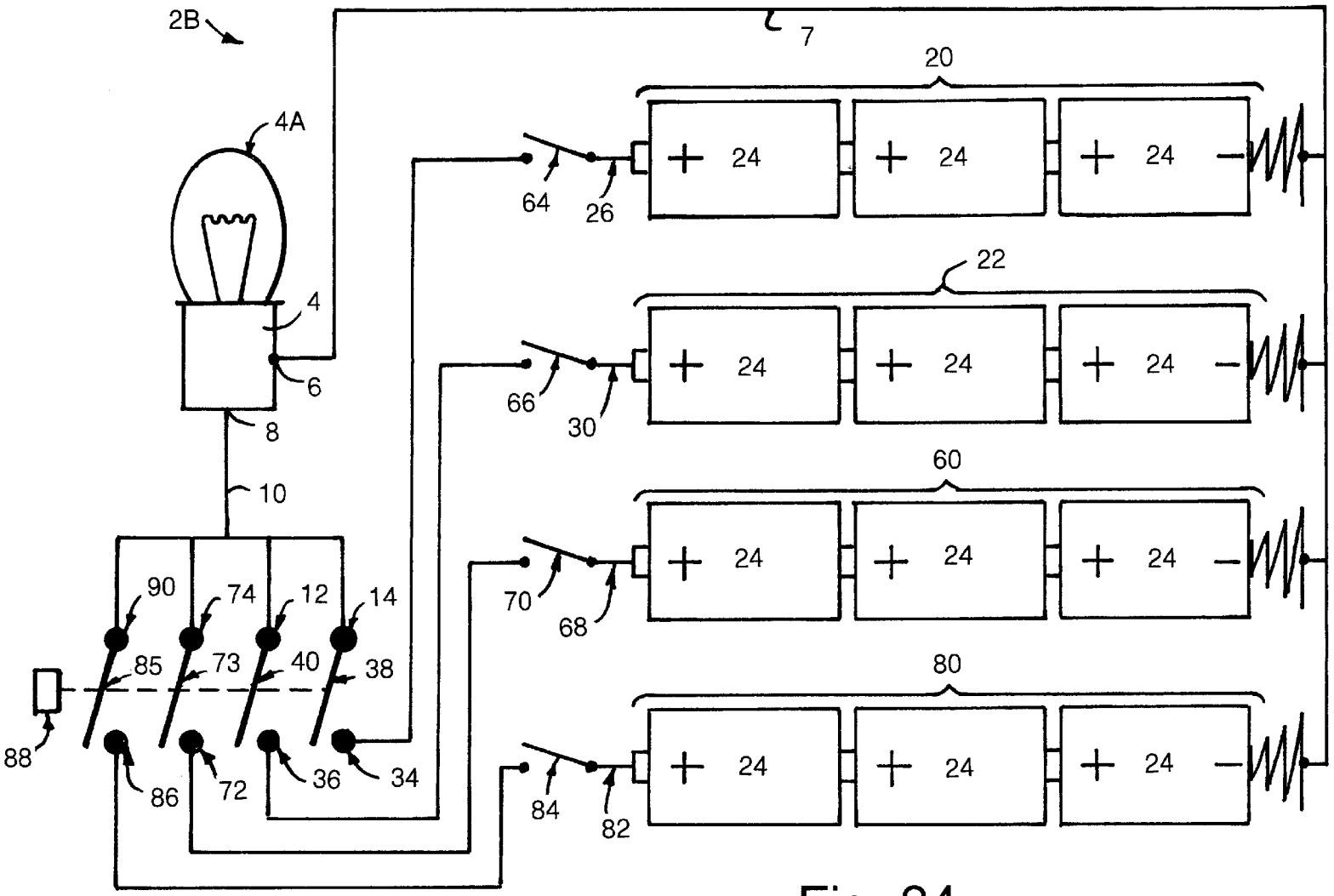
FIG. 24 illustrates a schematic of a portable lighting product circuit for use with the flashlight of FIGS. 17 to 22.

In the electrical connection means 26, 30 and 68, from the positive ends of the power sources 20, 22 and 60 and the respective poles 34, 36 and 72, are located single pole single throw switches 64, 66 and 70. These switches allow an operator to select either one of power sources 20, 22 and 60, or groups of them such as any two or all three of them, to be connected in parallel with the lamp holder 4, when the three pole switch 62 is activated, by closing switch mechanisms 73, 40 and 38 which will close the circuits between poles 74 & 72, 12 & 36 and 14 & 34. 17 to 22 illustrate a four power source housing flashlight similar to FIGS. 11 to 16 and like parts have been like numbered. FIG. 24 is an illustration of a circuit 2B embodying the invention for use with the flashlight of FIGS. 17 to 22. Like parts of FIG. 24 have been like numbered with like parts of FIG. 23.

In FIGS. 17 to 22 a fourth power source housing 180 is incorporated in the flashlight of these figures. The additional or fourth power source housing 180 houses power source 80 (of FIG. 24) and includes a set of three series connected dry cells 24 as illustrated in FIG. 24. The circuit 2B in FIG. 24 differs from the circuit 2A of FIG. 23 by the addition of: the power source 80 of three series connected dry cells; electrical connection means 82 from the positive end of the power source 80 to pole 86; parallel pole 90 on the lamp holder 4 side of the circuit 2B; switch mechanism 84 which serves the same function as switch mechanisms 64, 66 and 70 for the power source 80; and the substitution of the 3 pole switch 62 by a 4 pole switch 88, and a parallel connection to the other negative ends of the power sources 20, 22 and 60.

The circuit 2B of FIG. 24 functions in a similar manner to that of FIG. 23, in that the operator can select any one power source, group of two power sources, group of three power sources or all four power sources 20, 22, 60 and 80. However with an even number power sources 20, 22 60 and 80, double pole double throw switches similar to 42 can be connected into electrical connection means 26 & 30, and 68 & 82, so as to select two power sources such as 20 & 22 or 60 & 80 at a time.

If desired a single power source housing can be utilised to house all the power sources in such a way that the individual cells of each set are connected in series and in accordance with circuits of FIGS. 1, 23 or 24.

If the number of power sources is required to exceed that illustrated in FIGS. 1, 23 or 24, then the switching mechanisms will need to be commensurately altered and further electrical connection means added and if required single pole single throw switches for the selection of the power source or power sources. The proviso being that when the portable lighting product is switched off, the switch mechanisms electrically isolate all power sources with respect to each other.

Whilst in the above descriptions of the embodiments the switches and switching mechanisms are located on the positive side of the power source in the circuit, the switches and switching mechanisms could be located on the negative side as well. If there is more than one type of switch as in FIGS. 23 and 24, they may be on either the positive and negative sides of the circuit or on both sides of the circuit, or on the positive side of a first power source, the negative side of an adjacent power source and so on.

Preferably, the dry cells 24 are first installed in series connection into a cartridge mechanism to hold the sets of serially connected dry cells together to thereby form the power sources 20, 22 60 or 80, where upon they can then be placed inside the power source housings 50, 52 160 or 180 and the housings sealed by end caps 51 making the necessary connections into the open circuit or closed circuit if the appropriate switches are closed.

It may be desired to also associate with each set of series connected dry cells or power source, by providing appropriate circuitry, a battery life indicator so that an operator will be aware of the status of each power source 20, 22, 60 or 80.

The life of a dry cell is impacted by the rate at which current is drawn from the dry cell. When all of the dry cells in a portable lighting product are connected in series they are exposed to the same drain rate when a portable lighting product is switched on. However, if the exact same dry cells are connected in two equal numbered groups of series connected sets which are then connected in parallel, the drain rate per cell may be reduced somewhere in the range of 35% to 60% by comparison to the same number of cells all connected together by series connections. This reduction in drain rate allows the dry cells to discharge more efficiently and can thus improve the life or run time of the portable lighting product or other apparatus.

Figure 25:
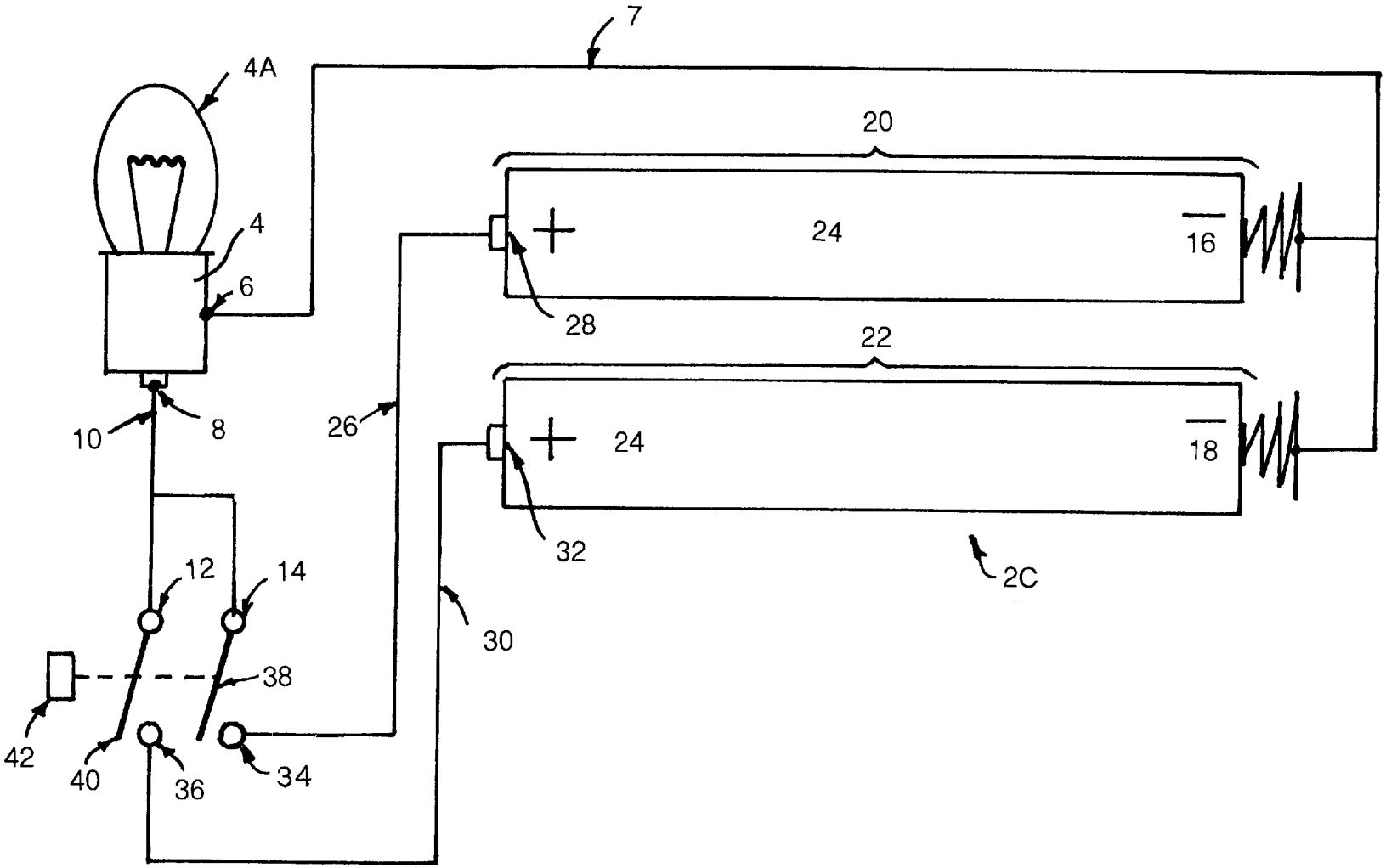
FIG. 25 illustrates a schematic of a circuit similar to that of FIG. 1 wherein only two single power sources are present.
Figure 26:
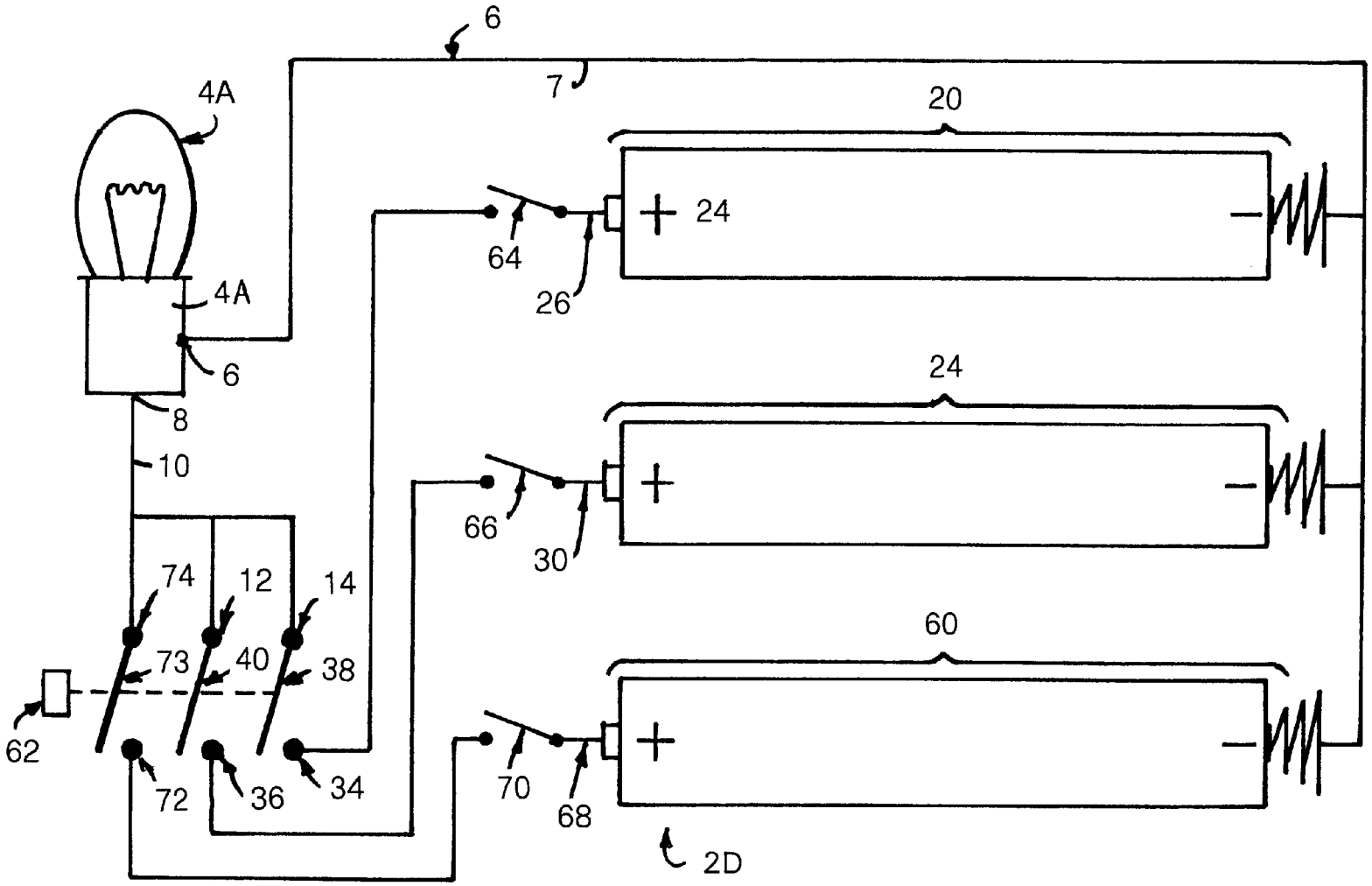
FIG. 26 illustrates a schematic of a circuit similar to that of FIG. 23 wherein three single power sources are present.
Figure 27:
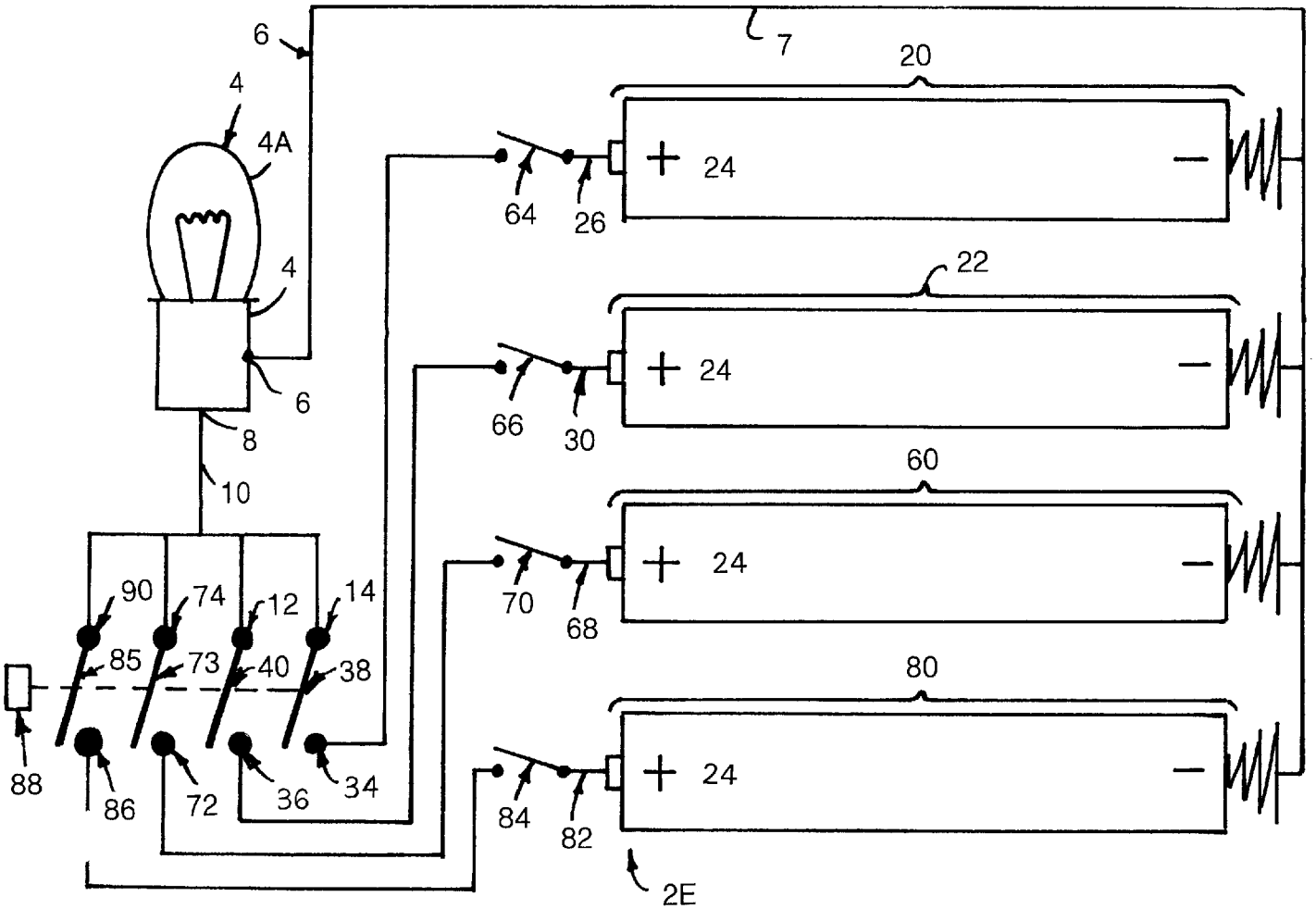
FIG. 27 illustrates a schematic of a circuit similar to that of FIG. 24 wherein four single power sources are present.

Illustrated in FIGS. 25, 26 and 27 are circuits 2C, 2D and 2E respectively. In these circuits the power sources 20, 22, 60 and 80, are each illustrated as being comprised of only one dry cell 24. Alternatively, the power sources 20, 22, 60 and 80 could be comprised of two or more series connected dry cells. It is envisaged that sets of series connected dry cells can be pre packaged, and would be sold for installation in equipment which incorporates any of the above described circuits. Alternatively, cartridges holding a predetermined number of appropriately sized dry cells could receive individual cells and which can then be installed in the portable lighting product. The circuits 2C, 2D, and 2E of FIGS. 25, 26 and 27 respectively, operate in the same manner as those of FIGS. 1, 23 and 24.

Whilst the above description refers to flashlights and portable lighting products generally, it will be understood that the inventions described are applicable to any dry cell powered portable lighting devices such as: torches, flashlights, lanterns, desk lamps, area lights, combination area flashlights, front bicycle lights, rear bicycle lights, emergency lights, night lights, and rechargeable versions of any of those products previously mentioned.

Whilst the above portable lighting products may be supplied with dry cells and power sources in the housings and chambers, they could be typically sold without said power sources and dry cells.

The foregoing describes embodiments of the present invention and modifications by those skilled in the art can be made thereto without departing from the scope of this invention.

What is claimed is:

1. An electrical circuit for a portable lighting product comprising:

a lamp holder having a positive terminal and a negative terminal;

a power source holder for holding at least two power sources, said power source holder having one set of positive and negative terminals for each power source that it is to hold, said sets of terminals being adapted to electrically connect the power sources in parallel with one another; and a switch mechanism coupled in series between said parallel power sources and said lamp holder such that, when said switch is open, said power sources are electrically isolated from one another, and when said switch is closed, at least one of said power sources may be electrically connected to said lamp holder.

2. The circuit as defined in claim 1, wherein said switch mechanism is configured to connect said power sources in parallel when said switch mechanism is closed and to electrically isolate said power sources when the circuit is opened by a single actuation of said switch mechanism.

3. The circuit as defined in claim 2 and further including an individual switch associated with each of said power sources, wherein the single actuation of said switch mechanism closes or opens said individual switches.

4. The circuit as defined in claim 1, wherein said switching mechanism isolates said power sources at one of the following: on a positive side of said power sources; on a negative side of said power sources; on both the negative and positive sides of said power sources; or on a combination of the positive and negative sides of said power sources.

5. The circuit as defined in claim 1, wherein said switching mechanism is a double throw switch.

6. The circuit as defined in claim 1, wherein each of said power sources is a single dry cell.

7. The circuit as defined in claim 1, wherein each of said power sources includes a set of dry cells electrically connected in series.

8. The circuit as defined in claim 7, wherein said dry cells are selected from one of the following sizes or types: AA size, AAA size, C size, D size, lantern type, 9 volt rectangular type.

9. The circuit as defined in claim 1, wherein said portable lighting product is selected from any one of the following products: flashlight, lantern, desk lamp, area light, combination area light and flashlight, front and rear bicycle light, emergency light, night light, and rechargeable versions of any of those products previously mentioned.

10. The circuit as defined in claim 1, wherein said lamp holder holds a lamp which is selected from one of the following: a halogen type; a krypton type; a vacuum type; a xenon type; and a lamp which includes a filament encased in an atmosphere of a gas or combination of gases.

11. An electrical circuit for a portable lighting product comprising:

a lamp holder having a positive terminal and a negative terminal;

at least two power source holders each for holding at least one power source, each of said power source holders having one set of positive and negative terminals for each power source that it is to hold, said sets of terminals being adapted to electrically connect said power sources in parallel with one another; and a switch mechanism coupled in series between said parallel power sources and said lamp holder such that, when said switch is open, said power sources are electrically isolated from one another, and when said switch is closed, at least one of said power sources may be electrically connected to said lamp holder.

12. The circuit as defined in claim 11, wherein said switch mechanism is configured to connect said power sources in parallel when said switch mechanism is closed and to electrically isolate said power sources when the circuit is opened by a single actuation of said switch mechanism.

13. The circuit as defined in claim 12 and further including an individual switch associated with each of said power sources, wherein the single actuation of said switch mechanism closes or opens said individual switches.

14. The circuit as defined in claim 11, wherein said switching mechanism isolates said power sources at one of the following: on a positive side of said power sources; on a negative side of said power sources; on both the negative and positive sides of said power sources; or on a combination of the positive and negative sides of said power sources.

15. The circuit as defined in claim 11, wherein said switching mechanism is a double throw switch.

16. The circuit as defined in claim 11, wherein each of said power sources is a single dry cell.

17. The circuit as defined in claim 11, wherein each of said power sources includes a set of dry cells electrically connected in series.

18. The circuit as defined in claim 17, wherein said dry cells are selected from one of the following sizes or types: AA size, AAA size, C size, D size, lantern type, 9 volt rectangular type.

19. The circuit as defined in claim 11, wherein said portable lighting product is selected from any one of the following products: flashlight, lantern, desk lamp, area light, combination area light and flashlight, front and rear bicycle light, emergency light, night light, and rechargeable versions of any of those products previously mentioned.

20. The circuit as defined in claim 11, wherein said lamp holder holds a lamp which is selected from one of the following: a halogen type; a krypton type; a vacuum type; a xenon type;

and a lamp which includes a filament encased in an atmosphere of a gas or combination of gases.

21. The circuit as defined in claim 11, wherein each of said power source holders holds only one power source.

22. The circuit as defined in claim 11, wherein each power source is located in a separate container or housing.

23. A portable lighting product comprising:

at least two power sources each having first and second terminals;

a lamp holder having first and second terminals, said first terminal of said lamp holder being adapted to be in electrical connection with a first terminal of said power sources, said second terminal of said lamp holder being adapted to be electrically connected to a second terminal of said power sources; and at least one switching mechanism for electrically isolating each power source from each other when said at least one switching mechanism is in a first condition, and when said at least one switching mechanism is in a second condition, said first terminals of said power sources are connected to one another and to said first terminal of said lamp holder and said second terminals of said power sources are connected to each other and to said second terminal of said lamp holder.

24. The portable lighting product as defined in claim 23 and further including at least one housing for each of said power sources.

25. The portable lighting product as defined in claim 23 and further including at least one housing adapted to hold more than one of said power sources.

26. The portable lighting product as defined in claim 23 and further including a second switch connected between said switching mechanism and said second terminal of said power sources or between said first terminal of said lamp holder and said first terminal of said power sources.

27. The portable lighting product as defined in claim 26, wherein said second switch is a single pole, single throw switch.

28. The portable lighting product as defined in claim 23, wherein said switching mechanism electrically connects two of said power sources with said lamp holder.

29. The portable lighting product as defined in claim 23, wherein said switching mechanism includes means for an operator to select which power source or groups of power sources are to be connected in parallel with each other and connected to said lamp holder.

30. The portable lighting product as defined in claim 23, wherein each said power source is a single dry cell.

31. The portable lighting product as defined in claim 23, wherein each said power source is a set of dry cells connected in series.

32. The portable lighting product as defined in claim 31, wherein said dry cells are selected from one of the following sizes, or types: AA size, AAA size, C size, D size, lantern type, 9 volt rectangular type.

33. The portable lighting product as defined in claim 23, wherein said portable lighting product is selected from any one of the following products: flashlight, lantern, desk lamp, area light, combination area light and flashlight, front and rear bicycle light, emergency light, night light, and rechargeable versions of any of those products previously mentioned.

34. The portable lighting product as defined in claim 23, wherein said lamp holder holds a lamp which is selected from one of the following: a halogen type; a krypton type; a vacuum type; a xenon type; and a lamp which includes a filament encased in an atmosphere of a gas or combination of gases.

35. A portable lighting product comprising a switching mechanism and a lamp holder having two terminals including a first terminal adapted to be electrically connected to a first terminal of at least two power sources, a second terminal of each of the power sources being adapted to be electrically connected to a switch mechanism, whereby a second terminal of said lamp holder is adapted to be selectively electrically connected to the second terminal of the power sources when said switch mechanism is in a first condition such that each of the power sources is electrically connected to said lamp holder in parallel, said switch mechanism being adapted to adopt a second condition in which the power sources are electrically isolated from each other.

36. A portable lighting product comprising:

a housing defining respective chambers for a plurality of power sources;

a light source portion associated with said housing including a holder for a lamp; and electrical circuit means including switching means adjustable between a first condition in which said lamp holder is electrically connected in parallel with said power sources, and a second condition in which said switching means breaks respective electrical circuits linking said lamp holder and the power sources and linking the sets of power sources.

37. A portable lighting product comprising:

a lamp holder having two terminals with a first terminal being adapted to be in electrical connection with a first terminal of at least two power sources and a second terminal of said lamp holder being adapted to be electrically connected to a second terminal of the at least two power sources; and at least one switching mechanism for electrically isolating each of the power sources, and for selectively allowing only one of the power sources to be in electrical connection with said lamp holder at any time.

38. A method for operating a portable lighting product circuit which includes a lamp holder and which contains at least two power sources adapted to be coupled in parallel and selectively connected to said lamp holder, said method including the step of electrically isolating each of said power sources from each other when said power sources are not electrically connected to said lamp holder.

39. The method as defined in claim 38, wherein each said power source is a single dry cell.

40. The method as defined in claim 38, wherein each said power source is a set of dry cells connected in series.

41. The method as defined in claim 40, wherein said dry cells are selected from one of the following sizes or types: AA size, AAA size, C size, D size, lantern type, 9 volt rectangular type.

42. The method as defined in claim 38, wherein said portable lighting product is selected from any one of the following products: flashlight, lantern, desk lamp, area light, combination area light and flashlight, front and rear bicycle light, emergency light, night light, rechargeable versions of any of those products previously mentioned.

43. The method as defined in claim 38, wherein said lamp holder holds a lamp which is selected from one of the following: a halogen type; a krypton type; a vacuum type; a xenon type; a lamp means which includes a filament encased in an atmosphere of a gas or combination of gases.

* * * * *